US007762040B2

(12) United States Patent
Wilson et al.

(10) Patent No.: US 7,762,040 B2
(45) Date of Patent: Jul. 27, 2010

(54) INSULATED FIBER CEMENT SIDING

(75) Inventors: Richard C. Wilson, Traverse City, MI (US); Patrick M. Culpepper, Massillon, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 1561 days.

(21) Appl. No.: 11/025,623

(22) Filed: Dec. 29, 2004

(65) Prior Publication Data

US 2006/0053740 A1 Mar. 16, 2006

Related U.S. Application Data

(60) Provisional application No. 60/600,845, filed on Aug. 12, 2004.

(51) Int. Cl.
*E04B 2/72* (2006.01)
*E04B 2/74* (2006.01)

(52) U.S. Cl. ..... 52/748.1; 52/747.11; 52/745.09; 52/518; 52/553

(58) Field of Classification Search ..... 52/309.4, 52/309.8, 416, 518, 526, 533, 535, 536, 539, 52/553, 560, 745.05, 745.06, 745.09, 746.1, 52/746.12, 717.11, 748.1
See application file for complete search history.

(56) References Cited

U.S. PATENT DOCUMENTS

| | | | | |
|---|---|---|---|---|
| 1,776,116 | A | 1/1928 | Harvey | |
| 1,882,529 | A | 3/1931 | Thulin | |
| 1,998,425 | A | 7/1934 | McNeil | |
| 2,317,926 | A | 12/1939 | Lindahl | |
| 2,308,789 | A | 2/1940 | Stagg | |
| 2,231,007 | A * | 2/1941 | Vane | 52/539 |
| 2,316,345 | A | 4/1943 | Logan, Jr. | 20/5 |
| 3,034,261 | A * | 5/1962 | Hollmann et al. | 52/553 |
| 3,124,427 | A | 3/1965 | Chomes | |
| 3,284,980 | A | 11/1966 | Dinkle | |
| 3,289,371 | A | 12/1966 | Pearson et al. | |
| 3,608,261 | A | 9/1971 | French et al. | |
| 3,742,668 | A | 7/1973 | Oliver | |
| 3,826,054 | A | 7/1974 | Culpepper, Jr. | |
| 3,868,300 | A | 2/1975 | Wheeler | |
| 3,887,410 | A | 6/1975 | Lindner | |
| 3,941,632 | A | 3/1976 | Swedenberg et al. | |
| 3,944,698 | A | 3/1976 | Dierks et al. | |
| 3,993,822 | A | 11/1976 | Knauf et al. | |

(Continued)

FOREIGN PATENT DOCUMENTS

| | | |
|---|---|---|
| CA | 721719 | 11/1965 |

(Continued)

*Primary Examiner*—Phi Dieu Tran A
(74) *Attorney, Agent, or Firm*—Young Basile

(57) ABSTRACT

A method for installing siding panels to a building includes providing a foam backing board having alignment ribs on a front surface and a drainage grid on a back surface and then establishing a reference line at a lower end of the building for aligning a lower edge of a first backing board and tacking thereon. Tabs and slots along vertical edges of the foam backing board align and secure adjacent backing boards to each other. A siding panel is butted against one of the lower alignment ribs and secured thereto. Another siding panel is butted against and secured to an adjacent alignment rib to form a shadow line between the adjacent siding panels on the building.

29 Claims, 7 Drawing Sheets

U.S. PATENT DOCUMENTS

| | | | | | |
|---|---|---|---|---|---|
| 3,998,021 | A | | 12/1976 | Lewis | |
| 4,015,391 | A | | 4/1977 | Epstein et al. | |
| 4,033,702 | A | | 7/1977 | Moerk, Jr. | |
| 4,033,802 | A | | 7/1977 | Culpepper, Jr. et al. | |
| 4,034,528 | A | | 7/1977 | Sanders et al. | |
| 4,065,333 | A | | 12/1977 | Lawlis et al. | |
| 4,073,997 | A | | 2/1978 | Richards et al. | |
| 4,081,939 | A | | 4/1978 | Culpepper, Jr. et al. | |
| 4,096,011 | A | | 6/1978 | Sanders et al. | |
| 4,098,044 | A | * | 7/1978 | Slavik | 52/302.1 |
| 4,181,767 | A | | 1/1980 | Steinau | |
| 4,188,762 | A | | 2/1980 | Tellman | |
| 4,242,406 | A | | 12/1980 | El Bouhnini et al. | |
| 4,244,761 | A | * | 1/1981 | Remi et al. | 156/71 |
| 4,277,526 | A | | 7/1981 | Jackson | |
| 4,288,959 | A | | 9/1981 | Murdock | |
| 4,296,169 | A | | 10/1981 | Shannon | |
| 4,301,633 | A | * | 11/1981 | Neumann | 52/309.4 |
| 4,303,722 | A | | 12/1981 | Pilgrim | |
| 4,320,613 | A | | 3/1982 | Kaufman | 52/521 |
| 4,335,177 | A | | 6/1982 | Takeuchi | |
| 4,351,867 | A | | 9/1982 | Mulvey et al. | |
| 4,361,616 | A | | 11/1982 | Bomers | |
| 4,366,197 | A | | 12/1982 | Hanlon et al. | |
| 4,369,610 | A | | 1/1983 | Volan | |
| 4,399,643 | A | * | 8/1983 | Hafner | 52/530 |
| 4,437,274 | A | | 3/1984 | Slocum et al. | |
| 4,468,909 | A | * | 9/1984 | Eaton | 52/541 |
| 4,477,300 | A | | 10/1984 | Pilgrim | |
| 4,504,533 | A | | 3/1985 | Altenhofer et al. | |
| 4,506,486 | A | * | 3/1985 | Culpepper et al. | 52/529 |
| 4,586,304 | A | * | 5/1986 | Flamand | 52/309.8 |
| 4,637,860 | A | | 1/1987 | Harper et al. | |
| 4,647,496 | A | | 3/1987 | Lehnert et al. | |
| 4,686,803 | A | | 8/1987 | Couderc et al. | |
| 4,722,866 | A | | 2/1988 | Wilson et al. | |
| 4,745,716 | A | | 5/1988 | Kuypers | |
| 4,810,569 | A | | 3/1989 | Lehnert et al. | |
| 4,864,788 | A | | 9/1989 | Tippmann | |
| 4,955,169 | A | * | 9/1990 | Shisko | 52/536 |
| 5,220,762 | A | | 6/1993 | Lehnert et al. | |
| 5,319,900 | A | | 6/1994 | Lehnert et al. | |
| 5,371,989 | A | | 12/1994 | Lehnert et al. | |
| 5,373,674 | A | * | 12/1994 | Winter, IV | 52/309.9 |
| 5,443,878 | A | | 8/1995 | Treloar et al. | |
| 5,501,056 | A | | 3/1996 | Hannah et al. | |
| 5,542,222 | A | | 8/1996 | Wilson et al. | |
| 5,601,888 | A | | 2/1997 | Flowler | |
| 5,644,880 | A | | 7/1997 | Lehnert et al. | |
| 5,704,179 | A | | 1/1998 | Lehnert et al. | |
| 5,772,846 | A | | 6/1998 | Jaffee | |
| 5,791,109 | A | | 8/1998 | Lehnert et al. | |
| 5,799,446 | A | | 9/1998 | Tamlyn | |
| D402,770 | S | | 12/1998 | Hendrickson et al. | |
| 5,945,182 | A | | 8/1999 | Fowler et al. | |
| 5,960,598 | A | | 10/1999 | Tamlyn | |
| 5,981,406 | A | | 11/1999 | Randall | |
| 5,987,835 | A | * | 11/1999 | Santarossa | 52/417 |
| 6,018,924 | A | | 2/2000 | Tamlyn | |
| 6,029,415 | A | | 2/2000 | Culpepper et al. | |
| 6,195,952 | B1 | | 3/2001 | Culpepper et al. | |
| 6,263,574 | B1 | | 7/2001 | Lubker, II et al. | |
| 6,276,107 | B1 | | 8/2001 | Waggoner et al. | |
| D448,865 | S | | 10/2001 | Manning | |
| D450,138 | S | | 11/2001 | Barber | |
| 6,321,500 | B1 | | 11/2001 | Manning et al. | |
| 6,337,138 | B1 | | 1/2002 | Zehner et al. | |
| 6,341,458 | B1 | | 1/2002 | Burt | |
| 6,345,479 | B1 | | 2/2002 | Hutchison et al. | |
| 6,354,049 | B1 | | 3/2002 | Bennett | |
| 6,358,585 | B1 | | 3/2002 | Wolff | |
| 6,360,508 | B1 | | 3/2002 | Pelfrey et al. | |
| 6,367,222 | B1 | | 4/2002 | Timbrel et al. | |
| 6,393,785 | B1 | | 5/2002 | Burt | |
| 6,409,952 | B1 | | 6/2002 | Hacker et al. | |
| 6,418,610 | B2 | | 7/2002 | Lubker, II et al. | |
| 6,453,630 | B1 | | 9/2002 | Buhrts | |
| 6,464,913 | B1 | | 10/2002 | Korney, Jr. | |
| D471,292 | S | | 3/2003 | Barber | |
| 6,526,718 | B2 | | 3/2003 | Manning et al. | |
| 6,684,597 | B1 | | 2/2004 | Butcher | |
| 6,792,725 | B1 | | 9/2004 | Rutherford | |
| 6,886,301 | B2 | | 5/2005 | Schilger | |
| 6,990,775 | B2 | | 1/2006 | Koester | |
| 7,059,087 | B2 | | 6/2006 | Allen | |
| 7,117,651 | B2 | | 10/2006 | Beck | |
| 2002/0029537 | A1 | | 3/2002 | Manning et al. | |
| 2003/0029097 | A1 | | 2/2003 | Albracht | |
| 2003/0056458 | A1 | | 3/2003 | Black et al. | |
| 2004/0200171 | A1 | | 10/2004 | Schilger | |
| 2004/0200183 | A1 | | 10/2004 | Schilger | |
| 2006/0068188 | A1 | | 3/2006 | Morse et al. | |

FOREIGN PATENT DOCUMENTS

| | | | |
|---|---|---|---|
| CA | 794590 | | 9/1968 |
| CA | 993779 | | 7/1976 |
| DE | 2808723 | A1 | 1/1980 |
| EP | 0148760 | A2 | 1/1985 |
| EP | 0148761 | A2 | 1/1985 |
| EP | 0943040 | B1 | 10/1997 |
| EP | 0973699 | B1 | 4/1998 |
| JP | 63294317 | | 1/1988 |
| JP | 2141484 | A2 | 11/1988 |
| JP | 5147997 | A2 | 11/1991 |
| JP | 04189938 | | 6/1992 |
| JP | 03337538 | | 6/1993 |
| JP | 6008219 | A2 | 1/1994 |
| WO | 9816697 | | 4/1998 |
| WO | 9845222 | | 10/1998 |
| WO | 0021901 | | 10/1999 |
| WO | 9957392 | | 11/1999 |
| WO | 0061519 | | 10/2000 |
| WO | 0142164 | A1 | 6/2001 |
| WO | 0225034 | A1 | 3/2002 |
| WO | 0231287 | A1 | 4/2002 |
| WO | 02070247 | A1 | 9/2002 |
| WO | 02070248 | A1 | 9/2002 |
| WO | 02070425 | A1 | 9/2002 |
| WO | 02081399 | A1 | 10/2002 |
| WO | 2004018090 | A1 | 3/2004 |

* cited by examiner

INSULATED FIBER CEMENT SIDING

This application claims priority of U.S. provisional patent application Ser. No. 60/600,845 filed on Aug. 12, 2004.

FIELD OF THE INVENTION

The invention is related to an insulated fiber cement siding.

BACKGROUND OF THE INVENTION

A new category of lap siding, made from fiber cement or composite wood materials, has been introduced into the residential and light commercial siding market during the past ten or more years. It has replaced a large portion of the wafer board siding market, which has been devastated by huge warranty claims and lawsuits resulting from delamination and surface irregularity problems.

Fiber cement siding has a number of excellent attributes which are derived from its fiber cement-base. Painted fiber cement looks and feels like wood. It is strong and has good impact resistance and it will not rot. It has a Class 1(A) fire rating and requires less frequent painting than wood siding. It will withstand termite attacks. Similarly composite wood siding has many advantages.

Fiber cement is available in at least 16 different faces that range in exposures from 4 inches to 10.75 inches The panels are approximately 5/16 inch thick and are generally 12 feet in length. They are packaged for shipment and storage in units that weigh roughly 5,000 pounds.

Fiber cement panels are much heavier than wood and are hard to cut requiring diamond tipped saw blades or a mechanical shear. Composite wood siding can also be difficult to work with. For example, a standard 12 foot length of the most popular 8¼ inch fiber cement lap siding weighs 20.6 pounds per piece. Moreover, installers report that it is both difficult and time consuming to install. Fiber cement lap siding panels, as well as wood composite siding panels, are installed starting at the bottom of a wall. The first course is positioned with a starter strip and is then blind nailed in the 1¼ inch high overlap area at the top of the panel (see FIG. 1). The next panel is installed so that the bottom 1¼ inch overlaps the piece that it is covering. This overlap is maintained on each successive course to give the siding the desired lapped siding appearance. The relative height of each panel must be meticulously measured and aligned before the panel can be fastened to each subsequent panel. If any panel is installed incorrectly the entire wall will thereafter be mis-spaced.

The current fiber cement lap siding has a very shallow 5/16 inch shadow line. The shadow line, in the case of this siding, is dictated by the 5/16 inch base material thickness. In recent years, to satisfy customer demand for the impressive appearance that is afforded by more attractive and dramatic shadow lines virtually all residential siding manufacturers have gradually increased their shadow lines from ½ inch and ⅝ inch to ¾ inch and 1 inch.

SUMMARY OF THE INVENTION

The present invention provides a novel installation method for fiber cement siding panels or composite wood siding panels. In particular, the present invention provides for a variety of different arrangements including an expanded polystyrene (EPS) contoured backing or other foam material backing to which the fiber cement siding or composite wood panel may be attached. An installer may abut a fiber cement board or a composite wood product against the contoured foam backing to achieve pre-defined alignment of the siding panel. This eliminates the meticulous measuring of overlap and leveling tasks associated with prior art installation methods.

According to a second preferred embodiment of the novel installation method of fiber cement or composite wood panels, a foam backing may be attached to the fiber cement or composite wood board. This foam backing has pre-defined dimensions which permit siding panels to be set one atop the next in such a fashion as to achieve pre-defined spacing and level boards. In solving the problems associated with fiber cement and wood composite siding, improvements to contoured foam backing have been discussed which have applicability to any type of siding product. These improvements include a tab and notch arrangement which allows laterally adjacent foam backers (i.e., side to side) to be mechanically fastened together. Further, it has been discovered that through the use of a foam backer the siding may be manufactured with a thinner gauge, including manufactured fiber cement and wood composite products.

The present invention also provides for a new and novel siding configuration which may be used with siding manufactured of any material including fiber cement, engineered composite wood and plastic, and cellulose-polyethylene materials to make the shadow line appear greater.

This method provides for the utilization of a thinner siding panel which is substantially supported by a foam backing.

DETAILED DESCRIPTION OF THE PREFERRED EMBODIMENT

The invention outlined hereinafter addresses the concerns of the aforementioned shortcomings or limitations of current fiber cement siding 10.

Figure 1:
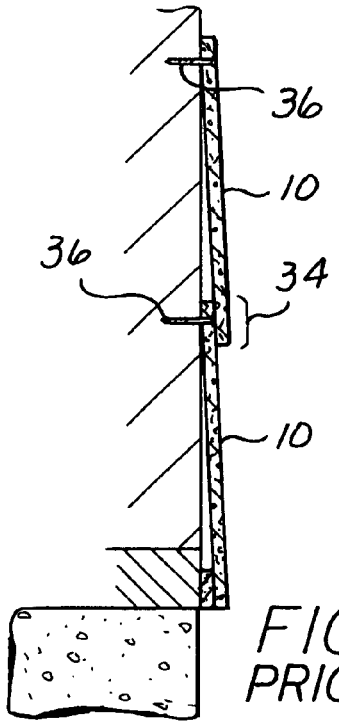
FIG. 1 PRIOR ART
FIG. 1 is a sectional view of a prior art fiber cement panel installation.
Figure 2A:
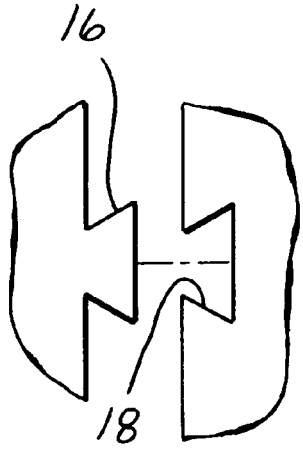
FIG. 2*a* is a portion of the installation board shown in FIG. 2 featuring interlocking tabs.
Figure 2:
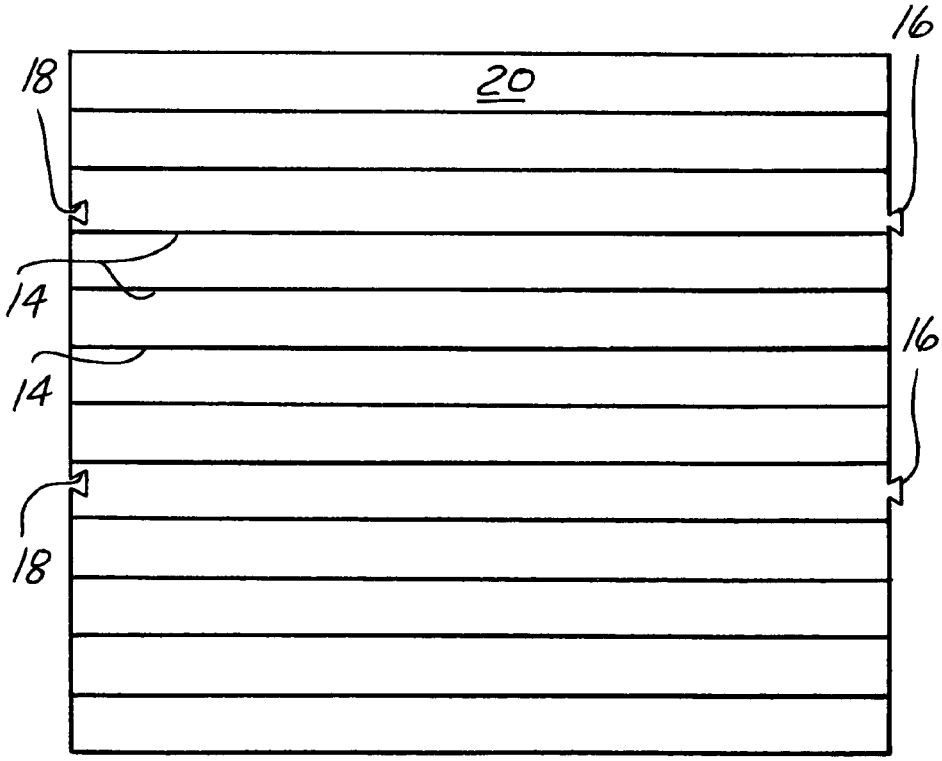
FIG. 2 is a plan view of a contoured alignment installation board according to a first preferred embodiment of the present invention.

A shape molded, extruded or wire cut foam board 12 has been developed to serve as a combination installation/alignment tool and an insulation board. This rectangular board 12, shown in FIG. 2 is designed to work with 1¼ inch trim accessories. The board's 12 exterior dimensions will vary depending upon the profile it has been designed to incorporate, see FIG. 3.

With reference to FIG. 2 there is shown a plan view of a contoured foam alignment backer utilized with the installation method of the first preferred embodiment. Installation and alignment foam board 12 includes a plurality or registration of alignment ribs 14 positioned longitudinally across board 12. Alignment board 12 further includes interlocking tabs 16 which interlock into grooves or slots 18. As illustrated in FIG. 2*a*, and in the preferred embodiment, this construction is a dovetail arrangement 16, 18. It is understood that the dovetail arrangement could be used with any type of siding product, including composite siding and the like where it is beneficial to attach adjacent foam panels.

Typical fiber cement lap siding panels 10 are available in 12 foot lengths and heights ranging from 5¼ inches to 12 inches. However, the foam boards 12 are designed specifically for a given profile height and face such as, Dutch lap, flat, beaded, etc. Each foam board 12 generally is designed to incorporate between four and twelve courses of a given fiber cement lap siding 10. Spacing between alignment ribs 14 may vary dependent upon a particular fiber cement siding panel 10 being used. Further size changes will naturally come with market requirements. Various materials may also be substituted for the fiber cement lap siding panels 10.

One commercially available material is an engineered wood product coated with special binders to add strength and moisture resistance; and further treated with a zinc borate-based treatment to resist fungal decay and termites. This product is available under the name of LP SmartSide® manufactured by LP Specialty Products, a unit of Louisiana-Pacific Corporation (LP) headquartered in Nashville, Tenn. Other substituted materials may include a combination of cellulose, wood and a plastic, such as polyethylene. Therefore, although this invention is discussed with and is primarily beneficial for use with fiber board, the invention is also applicable with the aforementioned substitutes and other alternative materials such as vinyl and rubber.

Figure 3:
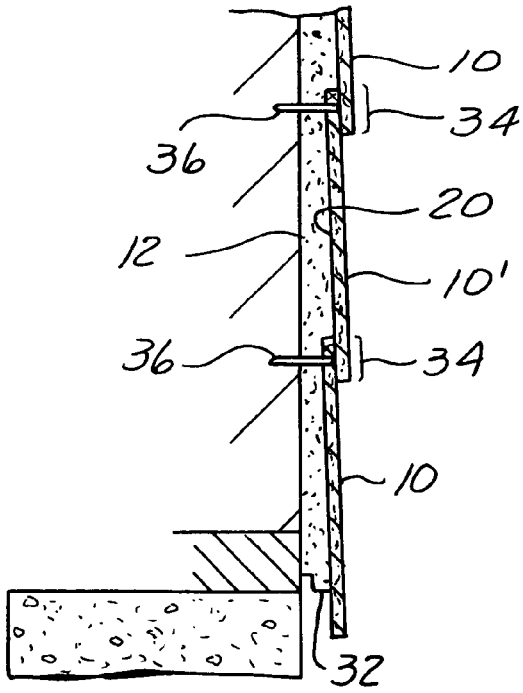
FIG. 3 is a sectional view of a fiber cement or wood composite installation using a first preferred method of installation.
Figure 4:
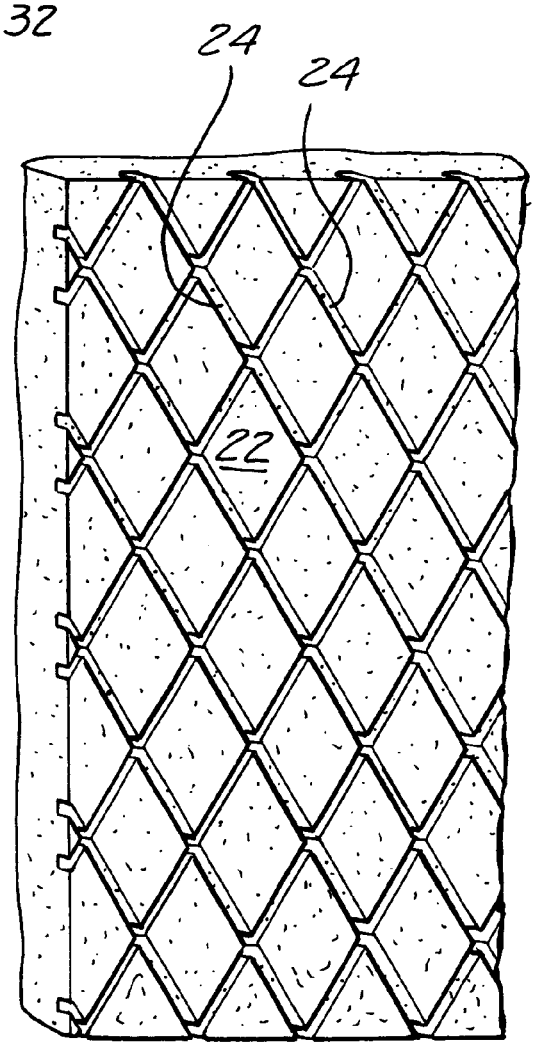
FIG. 4 is a rear perspective view of the installation board of FIG. 2.

The foam boards 12 incorporate a contour cut alignment configuration on the front side 20, as shown in FIG. 3. The back side 22 is flat to support it against the wall, as shown in FIG. 4. The flat side 22 of the board, FIG. 4, will likely incorporate a drainage plane system 24 to assist in directing moisture runoff, if moisture finds its way into the wall 12. It should be noted that moisture in the form of vapor, will pass through the foam from the warm side to the cold side with changes in temperature. The drainage plane system is incorporated by reference as disclosed in Application Ser. No. 60/511,527 filed on Oct. 15, 2003.

To install the fiber cement siding, according to the present invention, the installer must first establish a chalk line 26 at the bottom of the wall 28 of the building to serve as a straight reference line to position the foam board 12 for the first course 15 of foam board 12, following siding manufacturer's instructions.

Figure 5:
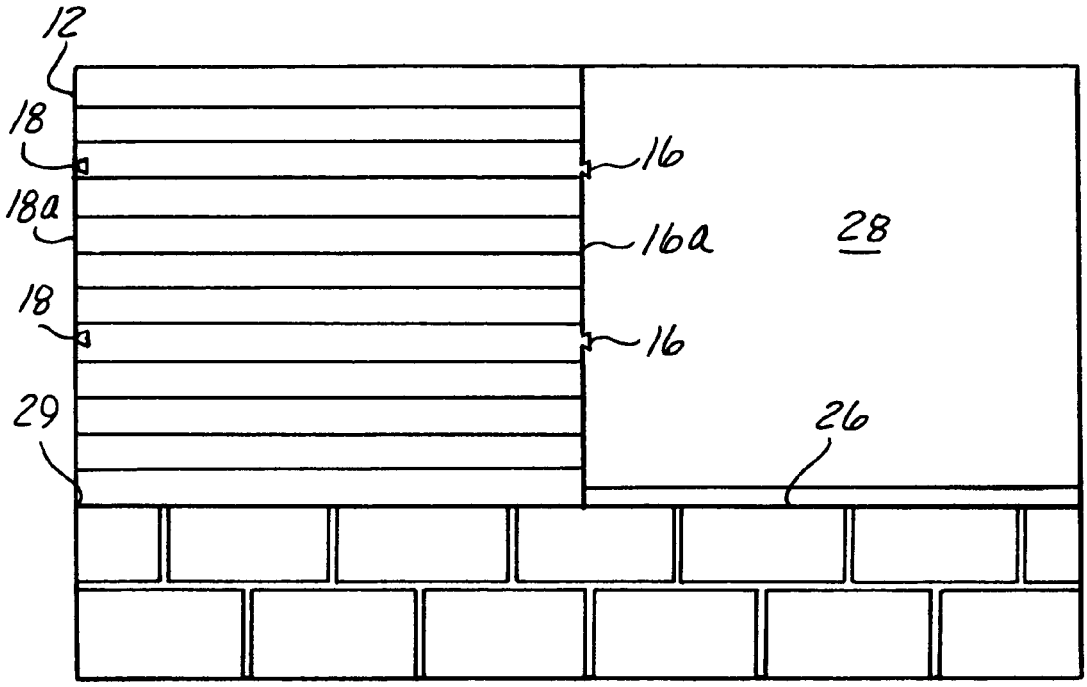
FIG. 5 is a plan view of an installation board according to a first preferred embodiment of the present invention attached to a wall.
Figure 6:
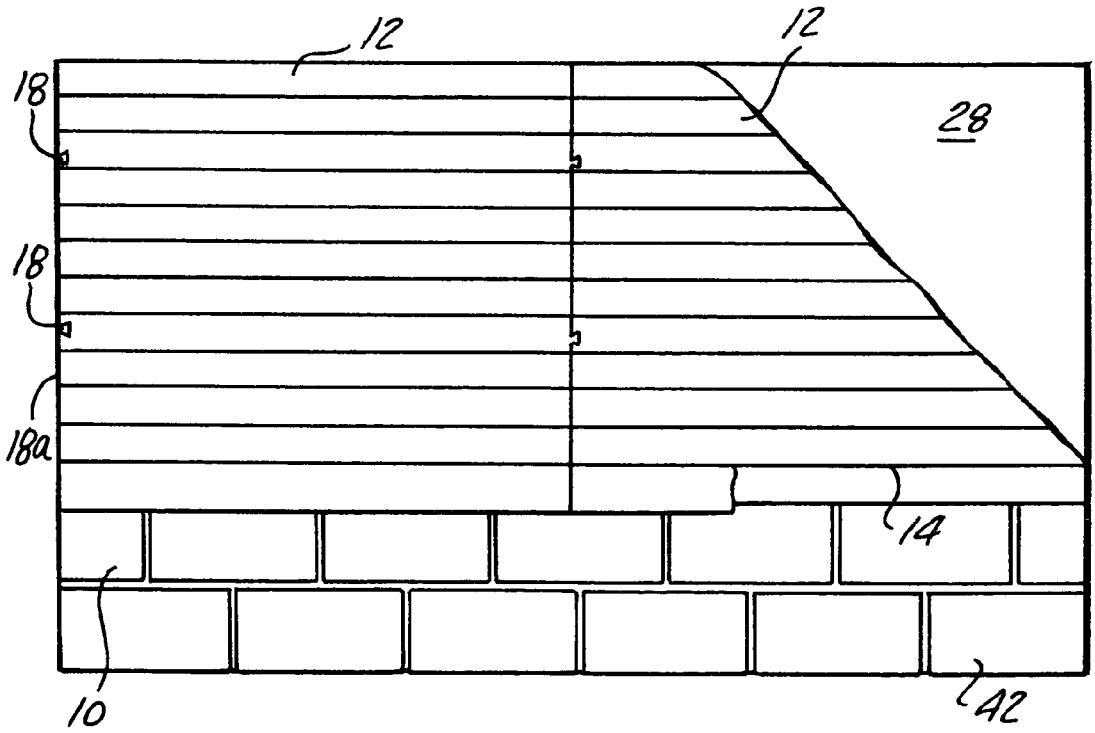
FIG. 6 is a plan view of an installation board on a wall.
Figure 7:
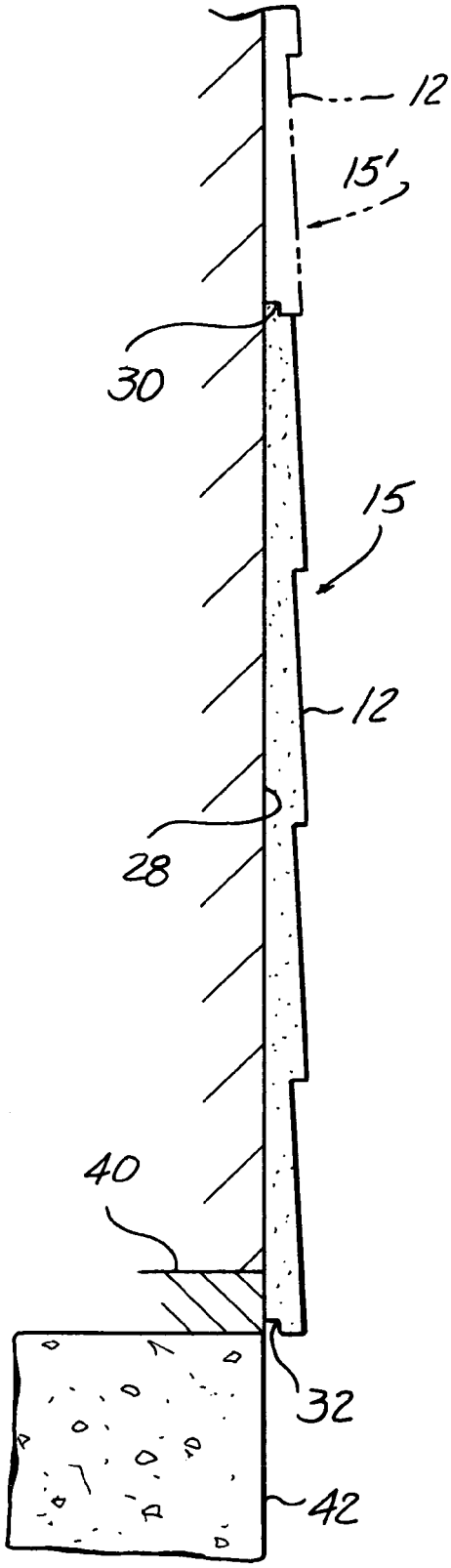
FIG. 7 is a sectional view of the installation board illustrating the feature of a ship lap utilized to attach multiple EPS foam backers or other foam material backers when practicing the method of the first preferred embodiment of the present invention.
Figure 7A:
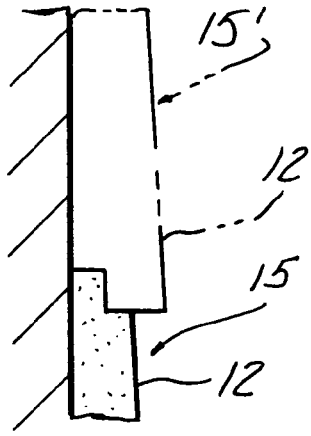
FIG. 7*a* is a sectional view of an upper ship lap joint.
Figure 7B:
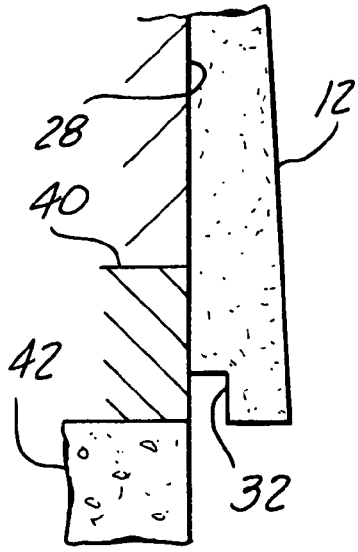
FIG. 7*b* is a sectional view of a lower ship lap joint.

The foam boards 12 are designed to be installed or mated tightly next to each other on the wall 28, both horizontally and vertically. The first course foam boards 12 are to be laid along the chalk line 26 beginning at the bottom corner of an exterior wall 28 of the building (as shown FIG. 5) and tacked into position. When installed correctly, this grid formation provided will help insure the proper spacing and alignment of each piece of lap siding 19. As shown in FIGS. 5 and 6, the vertical edges 16*a*, 18*a* of each foam board 12 are fabricated with an interlocking tab 16 and slot 18 mechanism that insure proper height alignment. Ensuring that the tabs 16 are fully interlocked and seated in the slots 18, provides proper alignment of the cement lap siding. As shown in FIGS. 7, 7*a*, 7*b*, the horizontal edges 30, 32 incorporate ship-lapped edges 30, 32 that allow both top and bottom foam boards 12 to mate tightly together. The foam boards 12 are also designed to provide proper horizontal spacing and alignment up the wall 28 from one course to the next, as shown in phantom in FIGS. 7 and 7*a*.

As the exterior wall 28 is covered with foam boards 12, it may be necessary to cut and fit the foam boards 12 as they mate next to doorways windows, gable corners, electrical outlets, water faucets, etc. This cutting and fitting can be accomplished using a circular saw, a razor knife or a hot knife. The opening (not shown) should be set back no more than ⅛ inches for foundation settling.

Once the first course 15 has been installed, the second course 15' of foam boards 12 can be installed at any time. The entire first course 15 on any given wall should be covered before the second course 15' is installed. It is important to insure that each foam board 12 is fully interlocked and seated on the interlocking tabs 16 to achieve correct alignment.

The first piece of fiber cement lap siding 10 is installed on the first course 15 of the foam board 12 and moved to a position approximately ⅛ inches set back from the corner and pushed up against the foam board registration or alignment rib 14 (see FIG. 8) to maintain proper positioning of the panel 10. The foam board registration or alignment rib 14 is used to align and space each fiber cement panel 10 properly as the siding job progresses. Unlike installing the fiber cement lap siding in the prior art, there is no need to measure the panel's relative face height to insure proper alignment. All the system mechanics have been accounted for in the rib 14 location on the foam board 12. The applicator simply places the panel 10 in position and pushes it tightly up against the foam board alignment rib 14 immediately prior to fastening. A second piece of fiber cement lap siding can be butted tightly to the first, pushed up against the registration or alignment rib and fastened securely with fasteners 17 with either a nail gun or hammer. Because the alignment ribs 14 are preformed and pre-measured to correspond to the appropriate overlap 30 between adjacent fiber cement siding panels 10, no measurement is required. Further, because the alignment ribs 14 are level with respect to one another, an installer need not perform the meticulous leveling tasks associated with the prior art methods of installation.

With reference to FIGS. 7, 7*a*, 7*b*, vertically aligned boards 20 include a ship lap 30, 32 mating arrangement which provides for a continuous foam surface. Furthermore, the interlocking tabs 16, 18 together with the ship lap 30, 32 ensures that adjacent fiber boards 12, whether they be vertically adjacent or horizontally adjacent, may be tightly and precisely mated together such that no further measurement or alignment is required to maintain appropriate spacing between adjacent boards 12. It is understood that as boards 12 are mounted and attached to one another it may be necessary to trim such boards when windows, corners, electrical outlets, water faucets, etc. are encountered. These cuts can be made with a circular saw, razor knife, or hot knife.

Thereafter, a second course of fiber cement siding 10' can be installed above the first course 10 by simply repeating the steps and without the need for leveling or measuring operation. When fully seated up against the foam board alignment rib 14, the fiber cement panel 10' will project down over the first course 10 to overlap 34 by a desired 1¼ inches, as built into the system as shown in FIG. 3. The next course is fastened against wall 28 using fasteners 36 as previously described. The foam board 12 must be fully and properly placed under all of the fiber cement panels 10. The installer should not attempt to fasten the fiber cement siding 10 in an area that it is not seated on and protected by a foam board 12.

The board 12, described above, will be fabricated from foam at a thickness of approximately 1¼ inch peak height. Depending on the siding profile, the board 12 should offer a system "R" value of 3.5 to 4.0. This addition is dramatic considering that the average home constructed in the 1960's has an "R" value of 8. An R-19 side wall is thought to be the optimum in thermal efficiency. The use of the foam board will provide a building that is cooler in the summer and warmer in the winter. The use of the foam board 12 of the present invention also increases thermal efficiency, decreases drafts and provides added comfort to a home.

Figure 9:
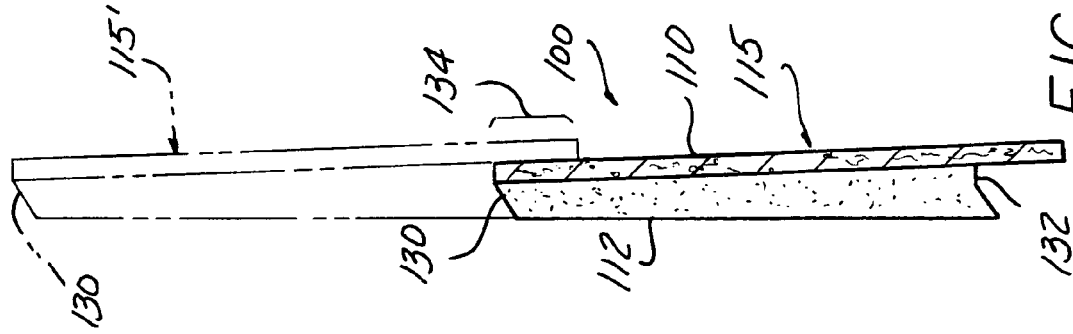
FIG. 9 is a second preferred embodiment of a method to install a fiber cement panel.

In an alternate embodiment, a family of insulated fiber cement lap siding panels 100 has been developed, as shown in FIG. 9, in the interest of solving several limitations associated with present fiber cement lap sidings. These composite panels 100 incorporate a foam backer 112 that has been bonded or laminated to a complementary fiber cement lap siding panel 110. Foam backing 112 preferably includes an angled portion 130 and a complementary angled portion 132 to allow multiple courses of composite fiber cement siding panels 100 to be adjoined. Foam backer 112 is positioned against fiber cement siding 110 in such a manner as to leave an overlap region 134 which will provide for an overlap of siding panels on installation.

The fiber cement composite siding panels 100 of the second preferred embodiment may be formed by providing appropriately configured foam backing pieces 132 which may be adhesively attached to the fiber cement siding panel 110. The composite siding panels 100 according to the second preferred embodiment may be installed as follows with reference to FIGS. 10*b*, 10*c* and 13. A first course 115 is aligned appropriately against sill plate 40 adjacent to the foundation 42 to be level and is fastened into place with fasteners 36. Thereafter, adjacent courses 115' may be merely rested upon the previous installed course and fastened into place. The complementary nature of angled portions 130, 132 will create a substantially uniformed and sealed foam barrier behind composite siding panels 100. Overlap 134, which has been pre-measured in relation to the foam pieces allows multiple courses to be installed without the need for measuring or further alignment. This dramatic new siding of the present invention combines an insulation component with an automatic self-aligning, stack-on siding design. The foam backer 112 provides a system "R" value in the range of 3.5 to 4.0. The foam backer 112 will also be fabricated from expanded polystyrene (EPS), which has been treated with a chemical additive to deter termites and carpenter ants.

The new self-aligning, stack-on siding design of the present invention provides fast, reliable alignment, as compared to the time consuming, repeated face measuring and alignment required on each course with the present lap design.

Figure 8A:
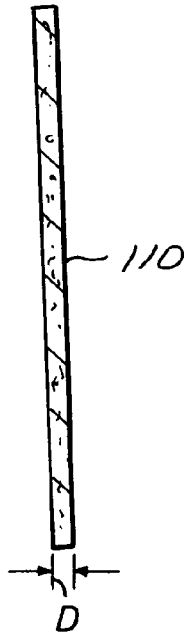
FIG. 8A PRIOR ART
FIG. 8*a* is a sectional view of the fiber cement board of the prior art panel.
Figure 8B:
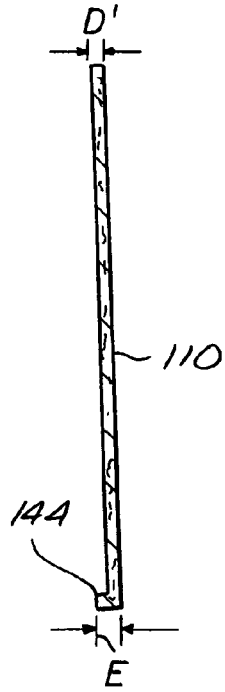
FIGS. 8*b*-8*d* are sectional views of fiber cement boards having various sized shadow lines.
Figure 8C:
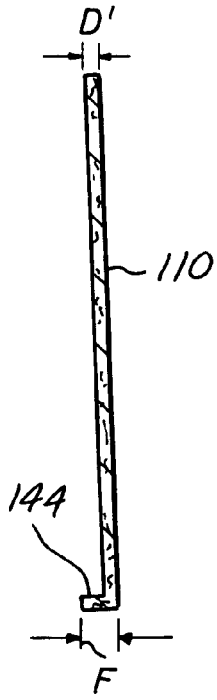

The new foam backer 112 has significant flexural and compressive strength. The fiber cement siding manufacturer can reasonably take advantage of these attributes. The weight of the fiber cement siding 110 can be dramatically reduced by thinning, redesigning and shaping some of the profiles of the fiber cement 110. FIG. 8*a* shows the current dimensions of fiber cement boards, FIGS. 8*b*, 8*c*, and 8*c* show thinner fiber cement board. Experience with other laminated siding products has shown that dramatic reductions in the base material can be made without adversely affecting the product's performance. The combination of weight reduction with the new stack-on design provides the installers with answers to their major objections. It is conceivable that the present thickness (D') of fiber cement lap siding panels 110 of approximately 0.313 inches could be reduced to a thickness (D') of 0.125 inches or less.

The fiber cement siding panel may include a lip 144 which, when mated to another course of similarly configured composite fiber cement siding can give the fiber cement siding 110 the appearance of being much thicker thus achieving an appearance of an increased shadow line. Further, it is understood although not required, that the fiber cement siding panel 110 may be of substantially reduced thickness, as stated supra, compared to the 5/16" thickness provided by the prior art. Reducing the thickness of the fiber cement siding panel 110 yields a substantially lighter product, thereby making it far easier to install. A pair of installed fiber cement composite panels having a thickness (D') of 0.125 or less is illustrated in FIGS. 8B-8D and 10B and 10C. Such installation is carried out in similar fashion as that described in the second preferred embodiment.

Figure 8D:
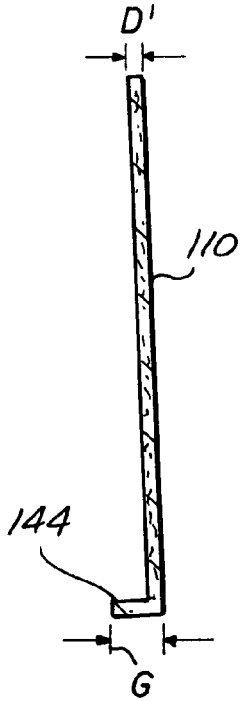
Figure 10C:
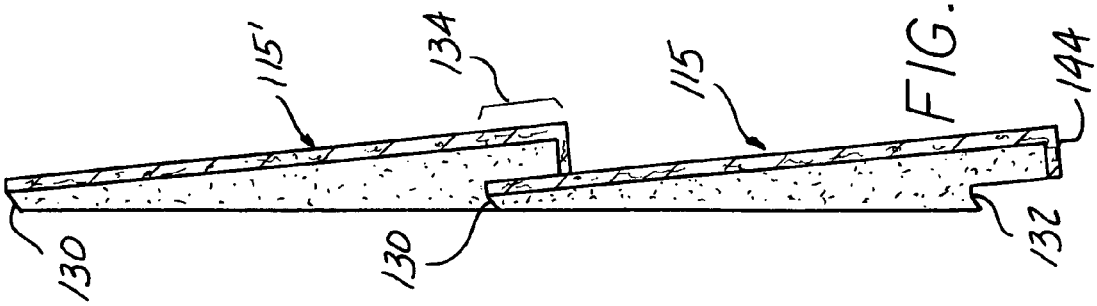
FIG. 10*c* shows the cement board in FIG. 8*d* installed over an installation board of the present invention.
Figure 10B:
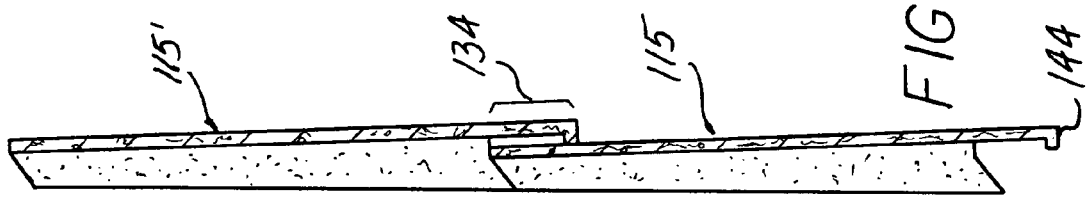
FIG. 10*b* shows the cement board in FIG. 8*c* installed over an installation board of the present invention.
Figure 10A:
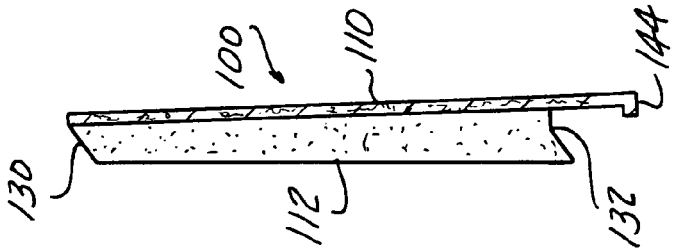
FIG. 10*a* shows the cement board in FIG. 8*b* installed over an installation board of the present invention.

The present invention provides for an alternate arrangement of foam 112 supporting the novel configuration of fiber cement paneling. In particular, the foam may include an undercut recess 132 which is configured to accommodate an adjacent piece of foam siding. As shown in FIGS. 10*a*, 10*b* and 10*c*, the new, thinner, insulated fiber cement lap siding panel 110 will allow the siding manufacturers to market panels with virtually any desirable shadow line, such as the popular new ¾ inch vinyl siding shadow line with the lip 144 formation. The lip 144 can have various lengths such as approximately 0.313 inch (E), 0.50 inch (F), and 0.75 (G) inch to illustrate a few variations as shown in FIGS. 8*b*, 8*c*, and 8*d*, respectively. This new attribute would offer an extremely valuable, previously unattainable, selling feature that is simply beyond the reach with the current system.

Figure 11:
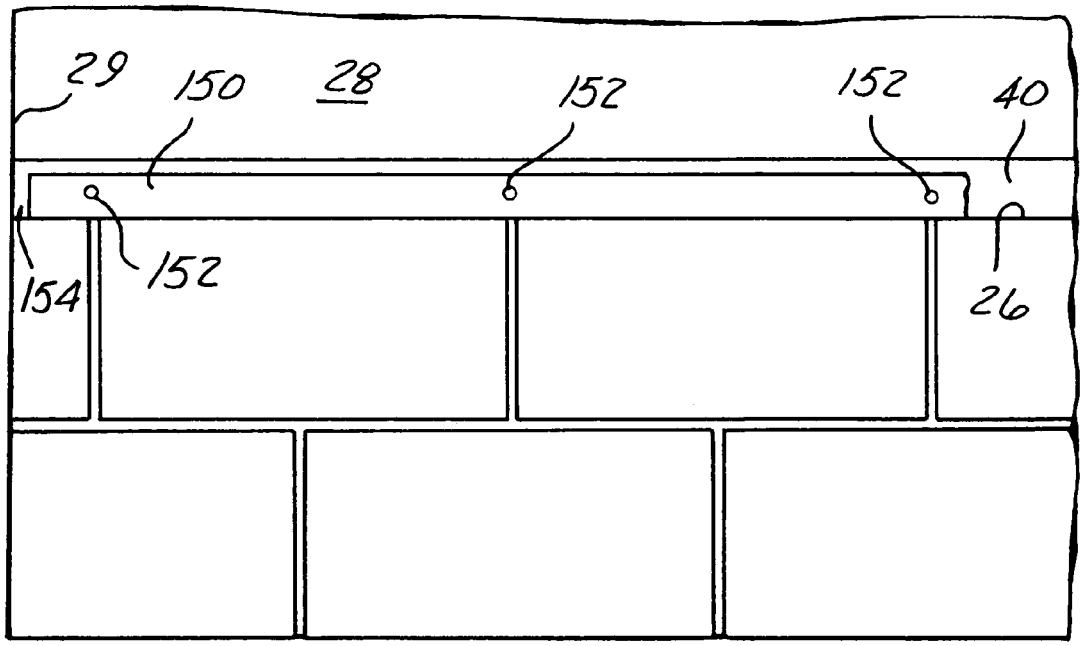
FIG. 11 illustrates the improved fiber cement or wood composite panel utilizing an installation method using a cement starter board strip.
Figure 12:
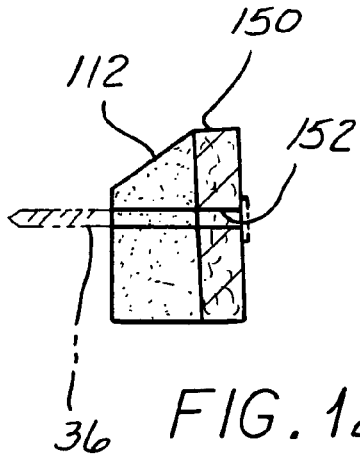
FIG. 12 is a sectional view of a starter board strip having a foam backer.

No special tools or equipment are required to install the new insulated fiber cement lap siding 100. However, a new starter adapter or strip 150 has been designed for use with this system, as shown in FIGS. 11 and 12. It is preferable to drill nail holes 152 through the adapter 150 prior to installation. The installer must first establish a chalk line 26 at the bottom of the wall 28 to serve as a straight reference line to position the starter adapter 150 for the first course of siding and follow the siding manufacturer's instructions.

Figure 13:
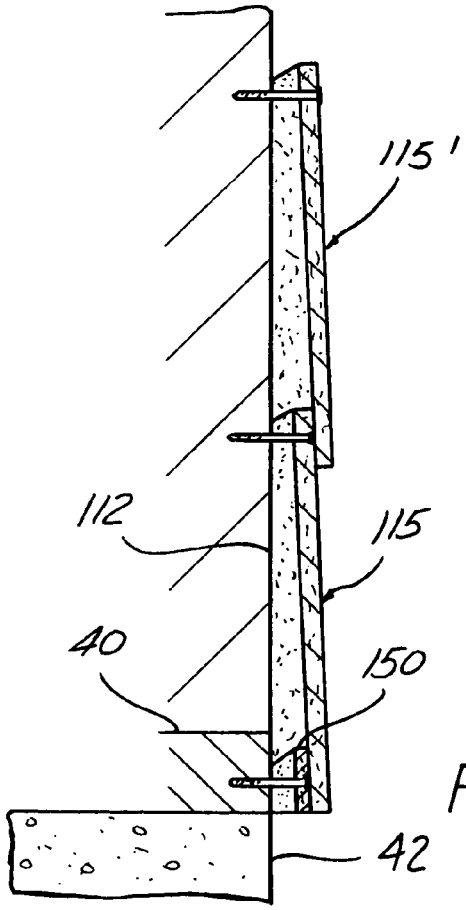
FIG. 13 illustrates a method for installing a first and second layer of fiber cement or wood composite panels.

The siding job can be started at either corner 29. The siding is placed on the starter adapter or strip 150 and seated fully and positioned, leaving a gap 154 of approximately ⅛ inches from the corner 29 of the building. Thereafter, the siding 100 is fastened per the siding manufacturer's installation recommendations using a nail gun or hammer to install the fasteners 36. Thereafter, a second course of siding 115' can be installed above the first course 115 by simply repeating the steps, as shown in FIG. 13. Where practical, it is preferable to fully install each course 115 before working up the wall, to help insure the best possible overall alignment. Installation in difficult and tight areas under and around windows, in gable ends, etc. is the same as the manufacturer's instruction of the current fiber cement lap siding 10 The lamination methods and adhesive system will be the same as those outlined in U.S. Pat. Nos. 6,019,415 and 6,195,92B1.

The insulated fiber cement stack-on sliding panels 100 described above will have a composite thickness of approximately 1¼ inches. Depending on the siding profile, the composite siding 100 should offer a system "R" value of 3.5 to 4.0. This addition is dramatic when you consider that the average home constructed in the 1960's has an "R" value of 8. An "R-19" side wall is thought to be the optimum in energy efficiency. A building will be cooler in the summer and warmer in the winter with the use of the insulated fiber cement siding of the present invention.

While the invention has been described in connection with what is presently considered to be the most practical and preferred embodiment, it is to be understood that the fiber cement siding board disclosed in the invention can be substituted with the aforementioned disclosed materials and is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for installing siding panels to a building comprises the steps of:

providing a foam backing board having predetermined dimensions having a flat back side for supporting against a wall of the building and a contour cut alignment configuration on the front side;

establishing a reference line at the bottom of the wall for aligning and positioning the foam backing board for a first course of the backing board;

laying a first lower edge of a first backing board along the reference line and tacking the first backing board into position;

laying subsequent backing boards in sequence horizontally adjacent to a previously tacked backing board to complete the first course; and installing at least one siding panel over at least a portion of the first backing board.

2. The method of claim 1, wherein the flat back side of the foam backing board has a drainage grid thereon.

3. The method of claim 1, wherein the step of laying subsequent backing boards adjacent the previously tacked backing board includes the step of interlocking the previous and subsequent backing board together with tabs and slots located on vertical edges of each backing board.

4. The method of claim 3, wherein the step of interlocking includes the step of seating the tabs into the slots.

5. The method of claim 1 further comprising the step of cutting and fitting the foam backing board around at least one of a doorway window, gable corner, electrical outlet and water faucet.

6. The method of claim 1, wherein the step of installing a siding panel includes the step of providing a fiber cement siding panel having a thickness of less than 0.13 inches.

7. The method of claim 6, wherein the step of providing a siding panel includes the step of providing a panel having a lip formation at one end for providing a shadow line.

8. The method of claim 7, wherein the lip formation is between 0.3 and 0.8 inches long.

9. The method of claim 1, wherein the siding panel is bonded to the foam backing board.

10. The method of claim 9, wherein the siding panel has a thickness less than 0.13 inches.

11. The method of claim 1, further comprising the step of abutting a subsequent siding panel against an alignment rib above and adjacent a previously used alignment rib so that the subsequent siding panel overlaps a previously installed siding panel for forming a shadow line.

12. The method of claim 1, wherein the step of providing a foam backing board includes the step of providing a foam backing board with an undercut recess at at least one end configured to accommodate an adjacent piece of foam backing board.

13. The method of claim 1, further comprising the step of treating the foam fiber board with a chemical additive for deterring termites and carpenter ants.

14. The method of claim 1, further comprising the step of installing a starter adapter adjacent the reference line.

15. The method of claim 14, wherein the foam backing board and siding panel are placed on the starter adapter and secured thereto.

16. The method of claim 1, wherein the siding panel is a fiber cement siding panel.

17. The method of claim 1, wherein the siding panel is of one of an engineered composite wood product, an engineered composite plastic product, and a combination cellulose, wood and plastic material.

18. The method of claim 1, wherein the siding panel comprises cellulosic fiber.

19. The method of claim 1, wherein the foam backing hoard is tapered from a relatively large thickness adjacent a first edge to a relatively small or zero thickness at a second edge opposite the first edge.

20. The method of claim 1, wherein the foam backing board is made of polypropylene or polyethylene.

21. The method of claim 1, wherein the foam backing board comprises polyurethane.

22. The method of claim 1, wherein the foam backing board comprises a porous, closed cell foam.

23. The method of claim 22, further comprising permitting moisture to drain from between the foam backing and the building wall by way of interstices between cells of the foam.

24. The method of claim 22, wherein the foam is tapered from a relatively large thickness adjacent a narrow region along a first edge of the substrate to a relatively small or zero thickness at a second edge of the substrate opposite the first edge, the method further comprising:

overlapping a second section of siding, shingle or shake with the first section of siding, shingle or shake, so that a rear surface of the foam on each of the first and second sections of siding, shingles or shake contacts the building surface.

25. The method of claim 22, wherein the foam covers a major surface of the siding, shingle or shake, except in a region where the section of siding, shingle or shake is to overlap a neighboring section of siding, shingle or shake.

26. The method of claim 1, wherein the installing step includes:

positioning the siding panel so that a major surface of the foam backing contacts the building wall and acts as a spacer to position the region of the siding panel at a non-zero distance from the building wall.

27. The method of claim 25, wherein the mounting step includes:

positioning the section of siding, shingle or shake so that a major surface of the foam faces away from the building surface and acts as a spacer to position a bottom portion of an adjacent second section of siding, shingle or shake at a non-zero distance from the building surface.

28. The method of claim 22, wherein:

the foam covers a rear surface of the siding, shingle or shake, except in a region where the section of siding, shingle or shake is to overlap a neighboring section of siding, shingle or shake, and the mounting step includes:

positioning the section of siding, shingle or shake so that a bottom edge of the foam rests on a top edge of an adjacent section of siding, shingle or shake.

29. The method of claim 2, wherein the drainage grid comprises grooves oriented so that they have a direction with a substantial vertical component when the siding panel is installed.

* * * * *